US006137975A

United States Patent [19]

Harumoto et al.

[11] Patent Number: 6,137,975

[45] Date of Patent: Oct. 24, 2000

[54] DEVELOPING DEVICE FOR PREVENTING AN OVERFLOW OF A DEVELOPER FROM A DEVELOPING UNIT

[75] Inventors: Katsumi Harumoto; Toyohiko Awano; Tetsuro Maeda; Shigemasa Nakaya; Toshio Uchida, all of Iwatsuki, Japan

[73] Assignee: Fuji Xerox Co., Ltd., Tokyo, Japan

[21] Appl. No.: 09/321,856

[22] Filed: May 28, 1999

[30] Foreign Application Priority Data

Jun. 30, 1998 [JP] Japan ..... 10-184800

[51] Int. Cl.[7] ..... G03G 15/01

[52] U.S. Cl. ..... 399/227

[58] Field of Search ..... 399/102, 103, 399/105, 106, 119, 226, 227

[56] References Cited

U.S. PATENT DOCUMENTS

| | | | |
|---|---|---|---|
| 4,460,267 | 7/1984 | Ogawa | 399/119 |
| 5,153,659 | 10/1992 | Maiefski et al. | 399/227 |
| 5,353,098 | 10/1994 | Lim | 399/119 |

*Primary Examiner*—William J. Royer
*Attorney, Agent, or Firm*—Oliff & Berridge, PLC

[57] ABSTRACT

A developing device is provided with developing unit covers mounted on opening portions of developing units through which developing rollers are exposed to close the opening portions. Due to such a construction, even when the developing units receive the vibration or the impact of falling during the course of transportation of an image forming apparatus on which the developing device is mounted, the overflow of a developer through the opening portion can be prevented.

19 Claims, 9 Drawing Sheets

DEVELOPING DEVICE FOR PREVENTING AN OVERFLOW OF A DEVELOPER FROM A DEVELOPING UNIT

BACKGROUND OF THE INVENTION

The present invention relates to a developing device in the field of an electrophotographic full color image forming apparatus and a method for using such a developing device.

Three developing units in which developers (each containing toner and carrier) of three primary colors are filled respectively are mounted on the electrophotographic full color image forming apparatus. Alternately, such an image forming apparatus may be further provided with another developing unit in which a black developer is filled. These developing units are arranged such that they face one or a plurality of photosensitive drums in an opposing manner. An image forming process is carried out by visualizing or developing electrostatic latent images with plural developers which are applied in sequence.

Because of the high fluidity of the developer containing toner and carrier, however, during the transportation of the electrophotographic full color image forming apparatus, due to an impact or a vibration which the apparatus receives, the developer filled in the developing unit may overflow from an opening through which a developing roller is exposed outside.

In such a case, there arises a problem that the overflown developer may hamper favorable prints after installing the electrophotographic full color image forming apparatus.

Such a tendency is becoming more apparent these days since handling of these apparatuses during transportation has been facilitated due to downsizing of apparatuses which enables transportation of the apparatuses even when their posture is up side down.

SUMMARY OF INVENTION

The present invention has been made in view of the above and it is an object of the present invention to provide a developing device and a method for using a developing device which can prevent an overflow of a developer from a developing unit.

According to one aspect of the present invention, a developer which contains at least toner and carrier is filled in a developing unit and this developer is transferred to a developing roller. Plural developing units are mounted on a rotator and they face a photosensitive drum in an opposing manner in sequence along with the rotation of the rotator so as to produce a multicolor image. Removable developer cartridges provide necessary developers to the developing units.

Closure members are provided to openings of the developing units through which developing rollers are exposed so as to close the openings. With such closure members, there is no fear that the developers are overflown into the image forming apparatus through the opening portions due to vibration or the like.

According to another aspect of the present invention, the closure members are mounted on the developing device at the time of shipping the image forming apparatus on which the developing device is mounted, while the closure members are removed from the developing device after installation of the image forming apparatus. With such a provision, there is no fear that the developers are overflown through the opening portions due to vibration or impact by falling which may occur during the transportation of the image forming apparatus.

Furthermore, in case of the developing device provided with plural developing units, so long as the developing device is not transported with its posture up side down, the closure member is mounted only to the opening portion which is directed downwardly and it is unnecessary to mount the closure members to all opening portions.

According to another aspect of the present invention, the closure members have a size which allows mounting and dismounting the closure members without being interfered by the rotator. Due to such a construction, while keeping the developing units in the rotator, the closure members can be mounted or dismounted thus facilitating the mounting and dismounting operations.

According to another aspect of the present invention, a direction of taking out the closure members is aligned with the axial direction of the developing rollers and hence, it is unnecessary to form opening portions for taking out the developing rollers which extend over the entire axial length of the developing rollers in the housing of the image forming apparatus.

According to another aspect of the present invention, the position where the closure members are removed is registered with the position where the developer cartridges are replaced and hence, it is unnecessary to form an opening portion for taking out the developer cartridges separately thus preventing lowering of rigidity of the housing.

According to another aspect of the present invention, an amount of protrusion of the closure member from the developing unit is set to a value which prevents the closure member from coming into contact with any parts except for the photosensitive drum when the rotator is rotated and hence, the damage which may be caused by rotating the rotator while mounting the closure member can be minimized.

According to another aspect of the present invention, a holding member is provided to the end portion of the closure member. By gripping this holding member, the pulling-out force is reliably transmitted to the closure member so that the removing operation is facilitated.

According to another aspect of the present invention, the holding member is an elongated holding member having flexibility. Due to such a construction, in case the closure members are mounted on the four developing units, even when the rotator is sequentially rotated for removing the closure members and accordingly the holding member comes into contact with the side plate of the rotator, it receives no damage. Furthermore, even when the holding member is sandwiched between the front cover and the rotator of the image forming apparatus, the holding member is merely deformed and receives no damage.

According to another aspect of the present invention, a protrusion which comes into contact with a flange portion of the photosensitive drum when the rotator is rotated is provided to the closure member. As the protrusion comes into contact with the flange portion, the rotation of the rotator is stopped and hence, the image region of the photosensitive drum where the image is formed is protected from any damage caused by the closure member.

According to another aspect of the present invention, the closure member is provided with a shield member which shields an inlet opening of a loading portion where a developer cartridge is loaded. Due to such a construction, to load the developer cartridge (usually, the developer cartridge being transported separately from the image forming apparatus), the shield member must be inevitably removed so that there is no fear that a user forgets removing of the closure member.

According to another aspect of the present invention, the closure member has a cover plate which covers an opening portion through which a developing roller is exposed, a claw which protrudes from the cover plate and is engaged with an engaging member which is mounted on the peripheral portion of the opening portion, and two rows of ribs which are protruded from the rear surface of the cover plate and inserted into gaps formed between the developing rollers and the opening portion.

Due to such a construction, the claw is instantly engaged with the engaging member provided to the peripheral portion of the opening portion so that the cover plate covers the opening portion to prevent the overflow of the developer adhered to the developing roller. Furthermore, two rows of ribs are inserted into the gaps defined between the developing rollers and the opening portions so as to prevent the overflow of the developer through the gaps.

According to another aspect of the present invention, the rib has a taper-shaped end portion which comes into contact with the developer adhered to the developing roller. In this manner, by having the taper-shaped end portion, the rib can be reliably inserted into the gap. Furthermore, by making the taper-shaped end portion come into contact with the developer, a wall made of the developer is formed between the rib and the developing roller thus preventing the overflow of the developer.

According to another aspect of the invention, an elastic seal member is provided and such an elastic seal member is located outside of the ribs and is compressed in a condition that the elastic seal member surrounds the peripheral portion of the opening portion. When this elastic seal member is deformed by compression, the gap formed between the rib and the opening portion (the gap along the axial direction of the developing roller) and the gap formed between the both ends of the developing roller and the cover plates are sealed thus completely preventing the overflow of the developer.

According to another aspect of the present invention, the elastic seal member is made of a foamed urethane having coarse pores. Using the foamed urethane having coarse pores (low hardness), the elastic seal member is compressed and deformed following the warp and the like of the opening portion so that high sealing ability can be obtained.

According to another aspect of the present invention, the claws and engaging members are formed in a given interval along the axial direction of the developing roller and hence, the small movement of the claws is sufficient to disengage the claws from the engaging members.

In this manner, with the small movement of the claws, namely, the small movement of the closure member, the closure member can be shifted from the opening portion so that the closure member can be removed easily.

According to another aspect of the present invention, a stopper member which stops the rotating operation of the rotator is connected to the photosensitive drum. Due to such a construction, the rotating operation of the rotator cannot be carried out until the photosensitive drum is removed from the image forming apparatus. Accordingly, even when the user forgets the removal of the closure member, the photosensitive drum which may be damaged is not present in the image forming apparatus thus the photosensitive drum is free from any damage.

According to another aspect of the present invention, the stopper member has a protective cover which is connected to the photosensitive drum and a recessed portion formed in the protective cover to be engaged with a knob mounted on the axial portion of the rotator.

Due to such a construction, so long as the photosensitive drum is not removed from the image forming apparatus, the protective cover cannot be removed from the rotator and the rotator cannot be manually rotated after gripping the knob. Accordingly, even when the rotator is rotated while holding the closure members on the rotator, no problem occurs since the photosensitive drum which may be damaged is not present in the image forming apparatus.

According to another aspect of the present invention, the developing device includes a developing unit which accommodates a developer containing at least toner and a developing roller and holds the developing roller while exposing a part of the developing roller, and a removable closure member which closes an opening portion of the developing unit through which the developing roller is exposed.

With such a provision, there is no fear that the developer is overflown through the opening portion due to vibration or impact by falling which may occur during the transportation of the image forming apparatus.

According to another aspect of the present invention, a developing unit which accommodates a developer containing at least toner and a developing roller and holds the developing roller while exposing a part of the developing roller, and a removable closure member which closes an opening portion of the developing unit through which the developing roller is exposed are provided, and the closure member is mounted before installing the developing unit or an image forming apparatus on which the developing unit is mounted, and the closure member is removed after installing the developing unit or the image forming apparatus on which the developing unit is mounted.

With such a method, there is no fear that the developer is overflown through the opening portion due to vibration or impact by falling which may occur during the transportation of the image forming apparatus.

DESCRIPTION OF THE PREFERRED EMBODIMENTS

The construction of the present invention is hereinafter explained in a preferred embodiment. This embodiment exemplifies a case where the invention is applied to a rotary developing device.

Figure 1:
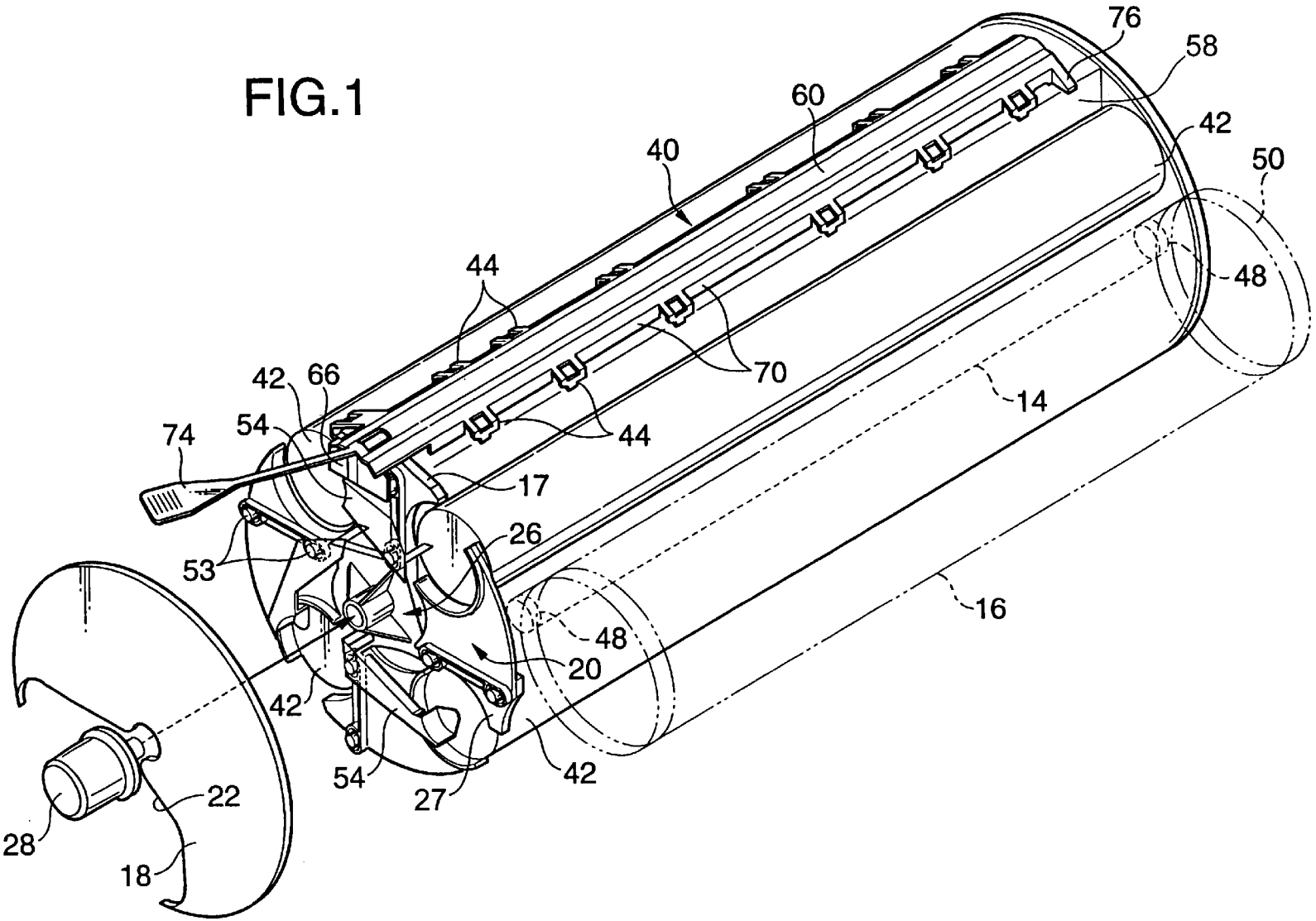
FIG. 1 is perspective view of a developing unit and a developing unit cover of a developing device according to an embodiment of the present invention.
Figure 2:
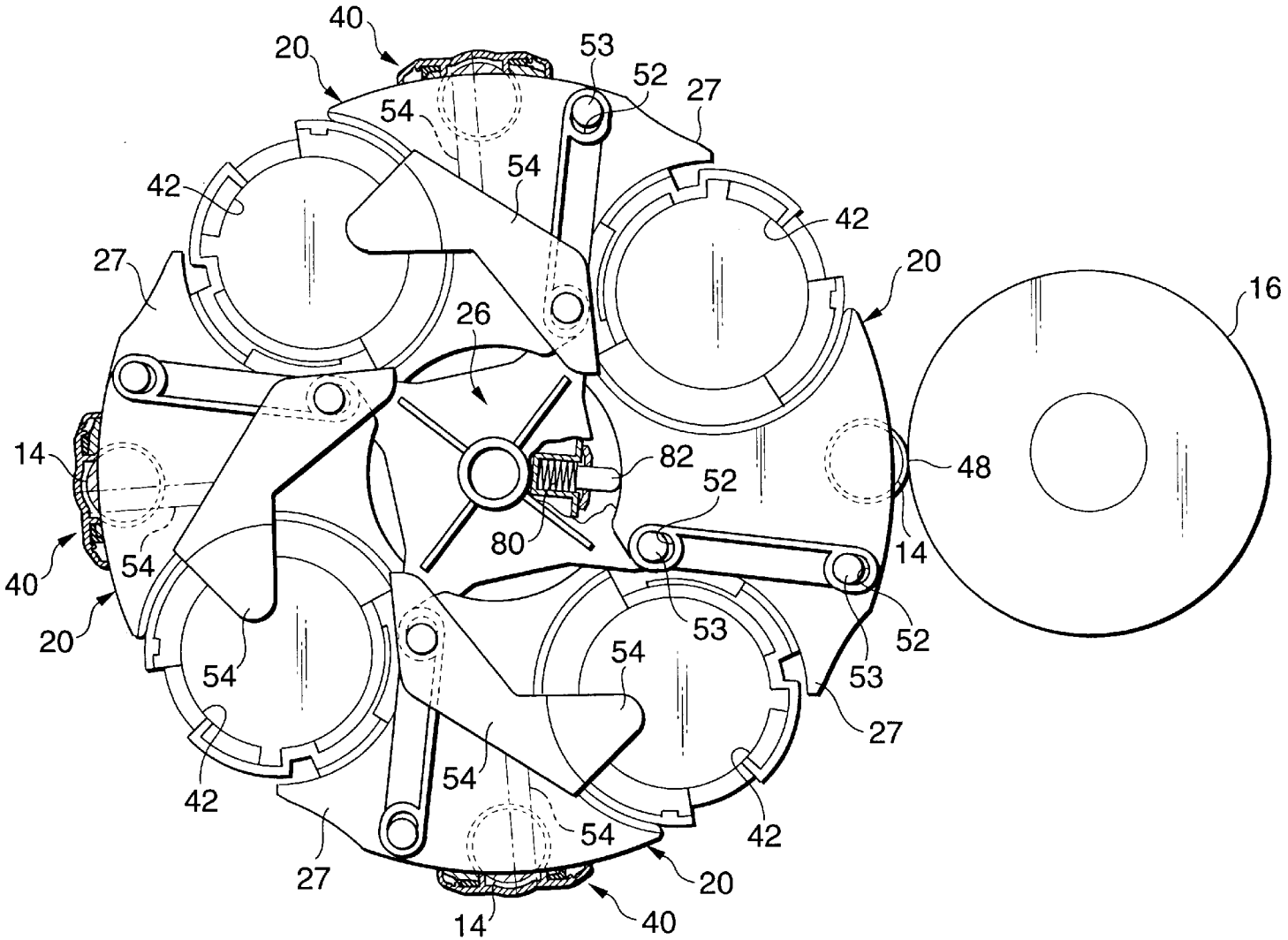
FIG. 2 is a side view of the developing device according to this embodiment to which a fixed plate is mounted.
Figure 9:
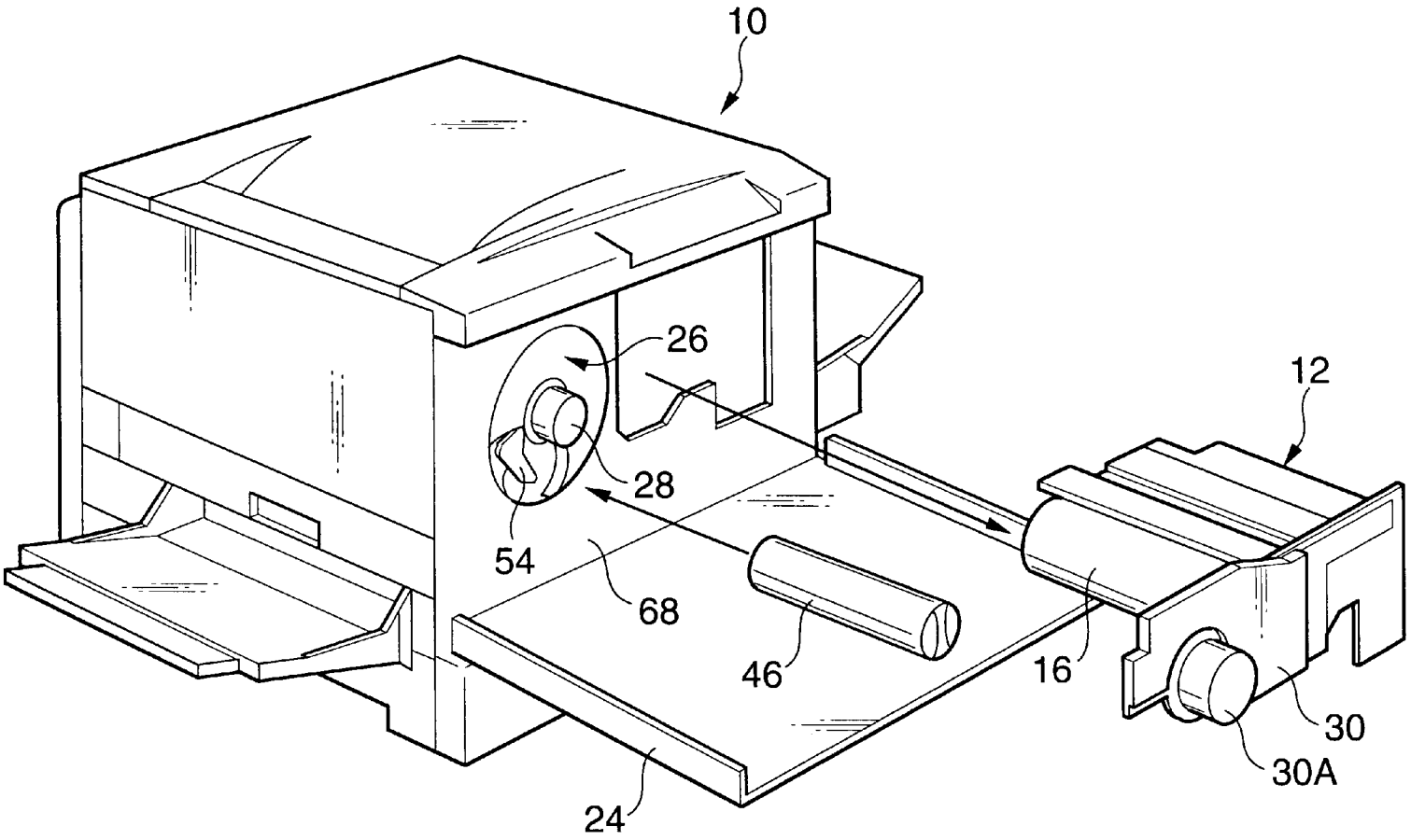
FIG. 9 is a perspective view of an image forming apparatus on which the developing device according to this embodiment is mounted.

As shown in FIG. 1, FIG. 2 and FIG. 9, a rotary developing device mounted on an image forming apparatus 10 is provided with a photosensitive unit 12 which includes a photosensitive drum 16. The photosensitive unit 12 is replaceably mounted on the image forming apparatus 10 and an approximately cruciform rotator 26 is disposed along the side of the photosensitive unit 12.

On arms 27 of the rotator 26, developing units 20 which contain developers or developing agents L assigned respectively to C(cyan), M(magenta), Y(yellow), BK(black) are mounted, wherein these developers are prepared by premixing toner and carrier. Developing rollers 14 of the developing units 20 which will be described later are exposed at positions where they face the photosensitive drum 16 in an opposing manner.

The photosensitive drum 16 is electrified by an electrification roller and then is exposed to laser beams which work as read elements so as to form an electrostatic latent image. This electrostatic latent image is developed or visualized in full colors by making the developing rollers 14 face the photosensitive drum 16 in an opposing manner in sequence along with the rotation of the rotator 26.

Figure 3:
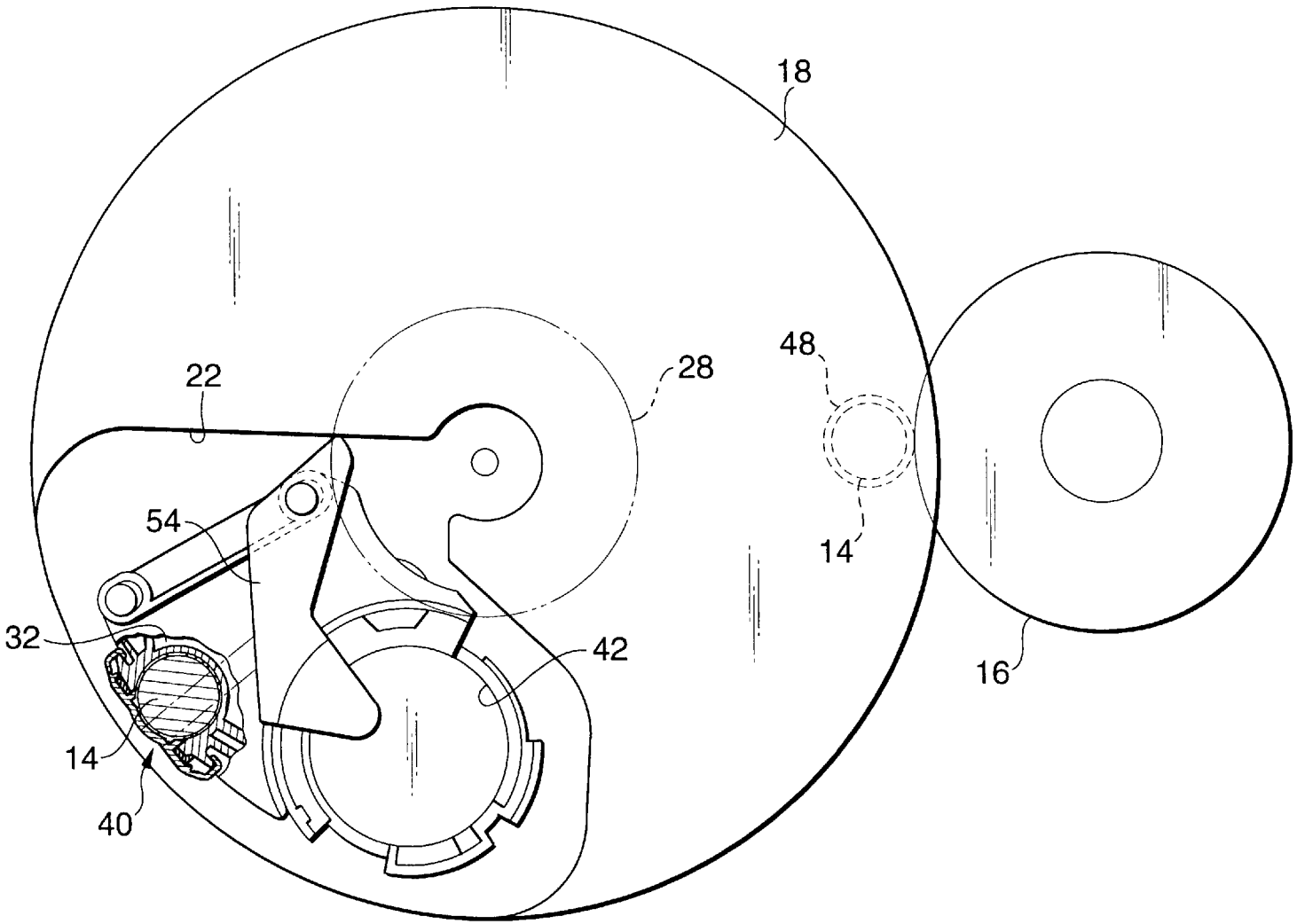
FIG. 3 is a cross-sectional side view of the essential portion of the developing device according to this embodiment.
Figure 4:
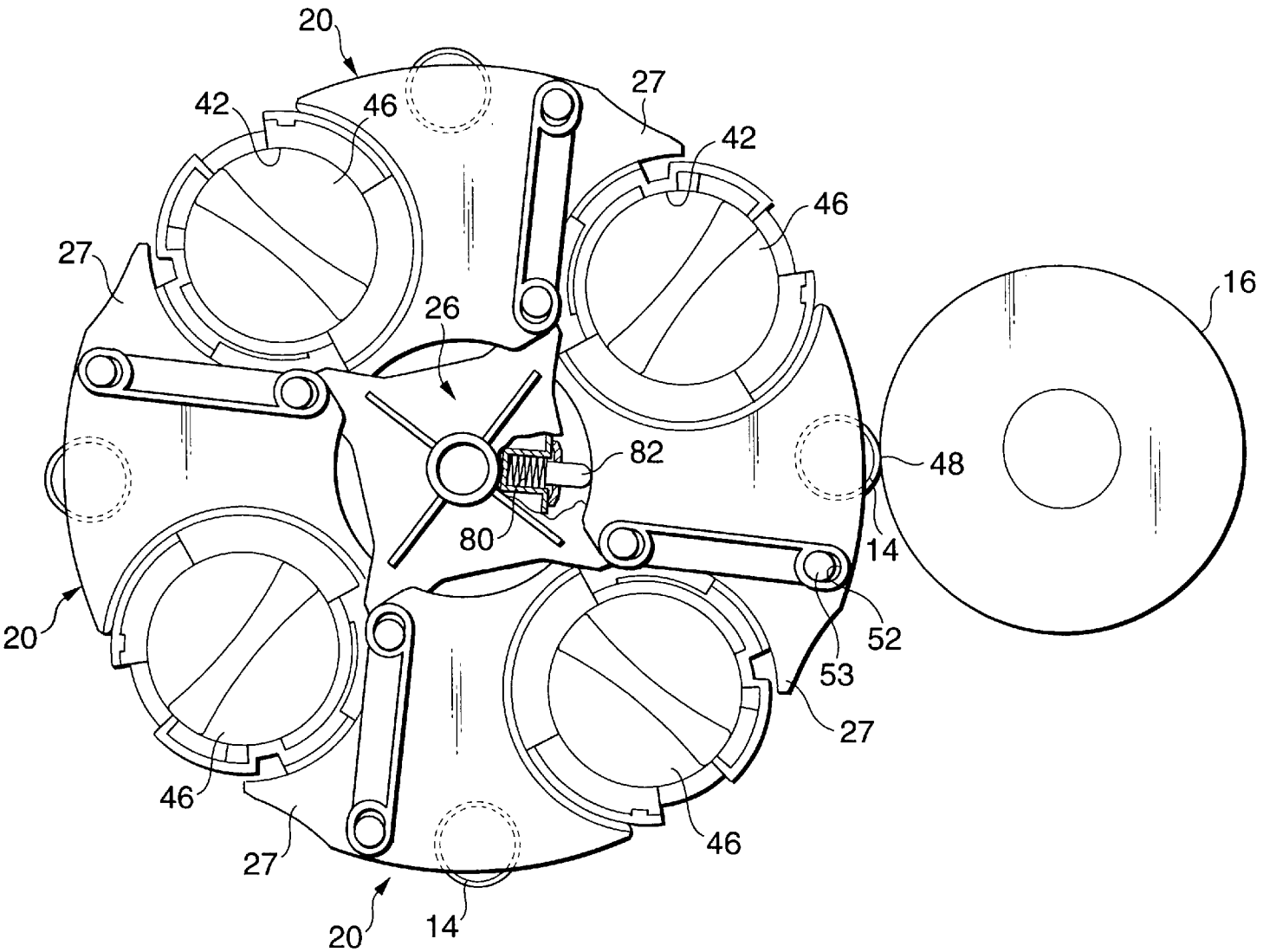
FIG. 4 is a side view of the developing device according to this embodiment with the fixed plate and the developing unit cover removed.
Figure 8:
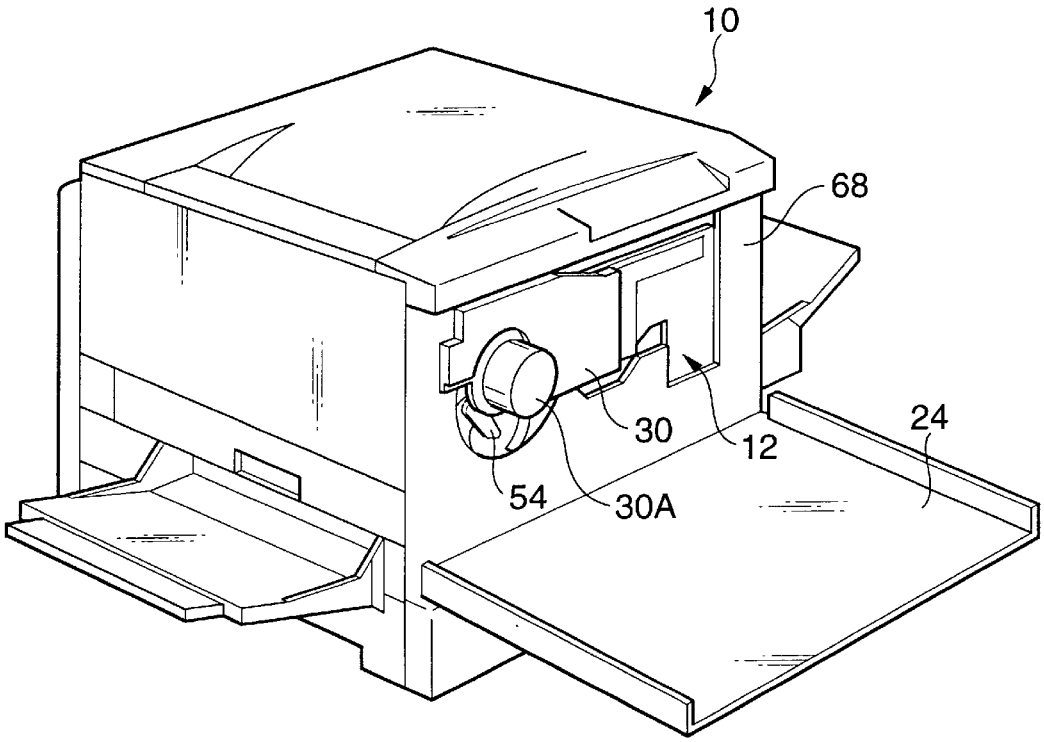
FIG. 8 is a perspective view of an image forming apparatus on which the developing device according to this embodiment is mounted.

On the other hand, as shown in FIG. 2 to FIG. 4, in a side plate 18 of the rotator 26, a take-out opening 22 which is large enough to pull out a developer cartridge 46 is formed. As shown in FIG. 8 and FIG. 9, this take-out opening 22 is formed at the side of a front cover 24 and the developer cartridge 46 can be mounted or dismounted by removing the front cover 24.

Furthermore, on the axial portion of the rotator 26, a rotary knob 28 is mounted at the side of the front cover 24. After gripping this rotary knob 28, the rotator 26 can be rotated manually and hence, any arbitrary developing unit 20 can be moved to the take-out opening 22.

A recessed portion 30A which is formed on a protective cover 30 is engaged with this rotary knob 28. To one end portion of the protective cover 30, the photosensitive unit 12 is connected. It is constructed such that so long as the photosensitive unit 12 is not removed from the image forming apparatus 10, the protective cover 30 cannot be disengaged from the rotary knob 28. In other words, so long as the photosensitive unit 12 is not removed from the image forming apparatus 10, the rotator 26 cannot be rotated manually.

On the other hand, as shown in FIG. 1 to FIG. 6, each developing unit 20 is provided with an elongated case 32 and the developer L is filled in the case 32. On the lateral side wall of the case 32, the developing roller 14 is rotatably mounted and is rotated by a gear mechanism mounted on the axial portion although not shown in the drawings.

This developing roller 14 has a portion of the outer peripheral surface thereof exposed through an opening portion 36 defined by a pair of housings 34 which protrude from the case 32 in a given spaced apart manner. A given gap is formed between the peripheral portions of the opening portion 36 and the developing roller 14 and hence, the developing roller 14 can be rotated with the developer L adhered to the developing roller 14.

Due to such a construction, the developing roller 14 absorbs carrier contained in the developer L and forms a magnetic brush and supplies toner absorbed in carrier to the photosensitive drum 16 whereby the latent image on the photosensitive drum 16 is visualized or developed.

Furthermore, on the outer surfaces of the housings 34, engaging members 38 are extended at a given interval and these engaging members 38 are engaged with claws 44 of a developing unit cover 40 which will be described later.

Two spiral augers are disposed in the case 32 in parallel with the developing roller 14. The spiral augers agitate the developer L while transferring the developer L and supply the developer L to the developing roller 14.

On the top surface of the case 32, a cylindrical casing 42 is mounted. Upon mounting of the developer cartridge 46 to this casing 42, the developer L is supplied to the inside of the case 32 through the take-out opening formed in the casing 42.

Furthermore, on both end portions of the developing roller 14, tracking rollers 48 which have a diameter slightly larger than that of the developing roller 14 are mounted coaxially. These tracking rollers 48 come into contact with the photosensitive drum 16 and form a given gap between the photosensitive drum 16 and the developing roller 14.

Furthermore, the case 32 of the developing unit 20 is provided with an elongated hole 52 which extends in a radial direction of the rotator 26. A pin 53 which is protruded from the arm 27 is inserted in this elongated hole 52 and hence, the developing unit 20 is held in such a manner that the unit 20 can be slid in a radial direction of the rotator 26.

Still furthermore, a spring 80 is disposed at the central portion of the rotator 26 and a pin 82 biased by the spring 80 pushes the developing unit 20 in a radially outward direction. Accordingly, the tracking rollers 48 are brought into contact with the photosensitive drum 16 at a given pressure.

Figure 7:
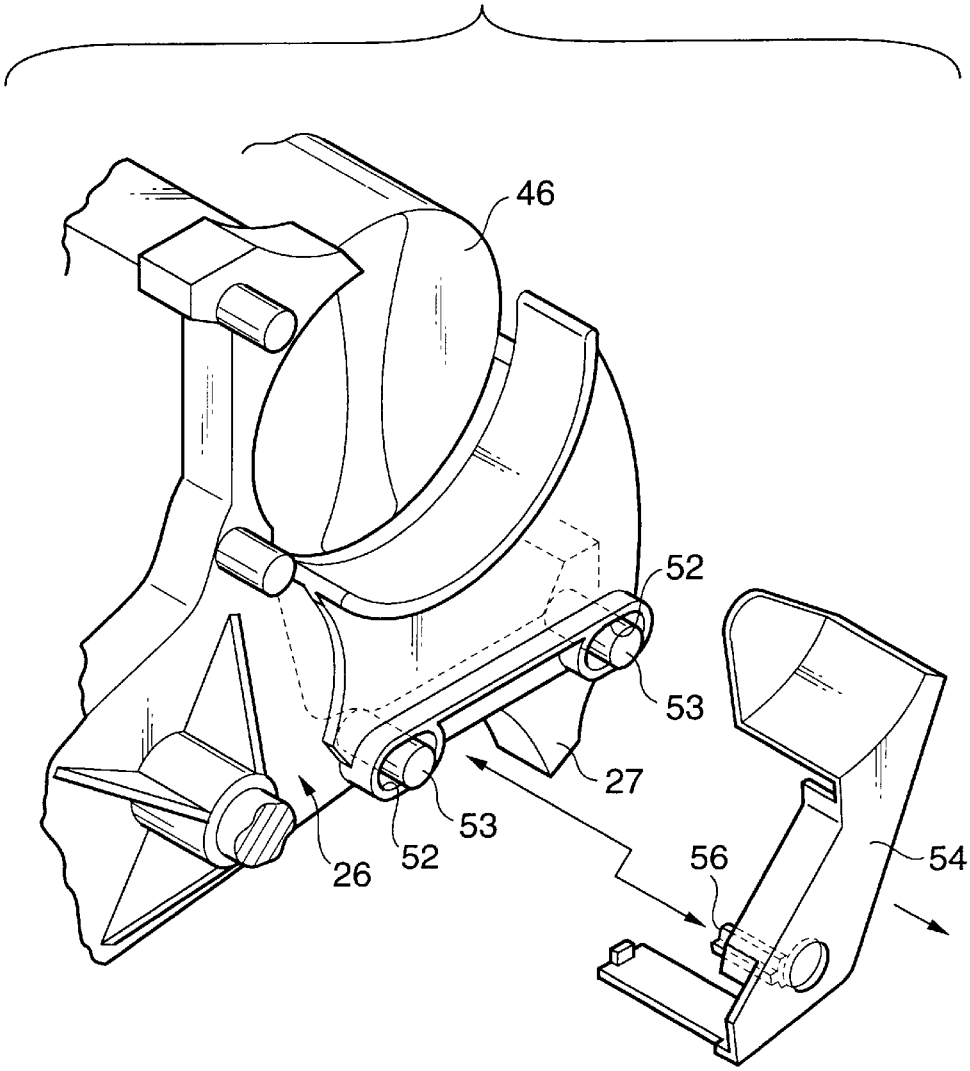
FIG. 7 is a perspective view showing the fixed plate of the developing device according to this embodiment.

Additionally, as shown in FIG. 7, a lock pin 56 which protrudes from the fixed plate 54 is inserted in a gap defined between the elongated hole 52 and the pin 53. The developing unit 20 is pushed in a direction opposed to the photosensitive drum 16 by this lock pin 56 against the biasing force of the spring 80.

Due to such a construction, during transportation of the image forming apparatus 10, the movement of the developing units 20 relative to the rotator 26 can be prevented and the tracking rollers 48 are prevented from coming into contact with the photosensitive drum 16. Accordingly, a problem that the tracking rollers 48 come into contact with the photosensitive drum 16 so that the developer L is flown out through the opening portion 36 or the photosensitive drum 16 is damaged can be effectively prevented.

Furthermore, the fixed plates 54 extend to the inlets of the casings 42. Accordingly, so long as the fixed plates 54 are not removed, the developer cartridges 46 which are separately shipped cannot be loaded into the casings 42 (see FIG. 9).

The fixed plates 54 are connected to the developing unit covers 40 by way of connecting plates 58 so that the developing unit covers 40 are integrally moved with the fixed plates 54.

Figure 5:
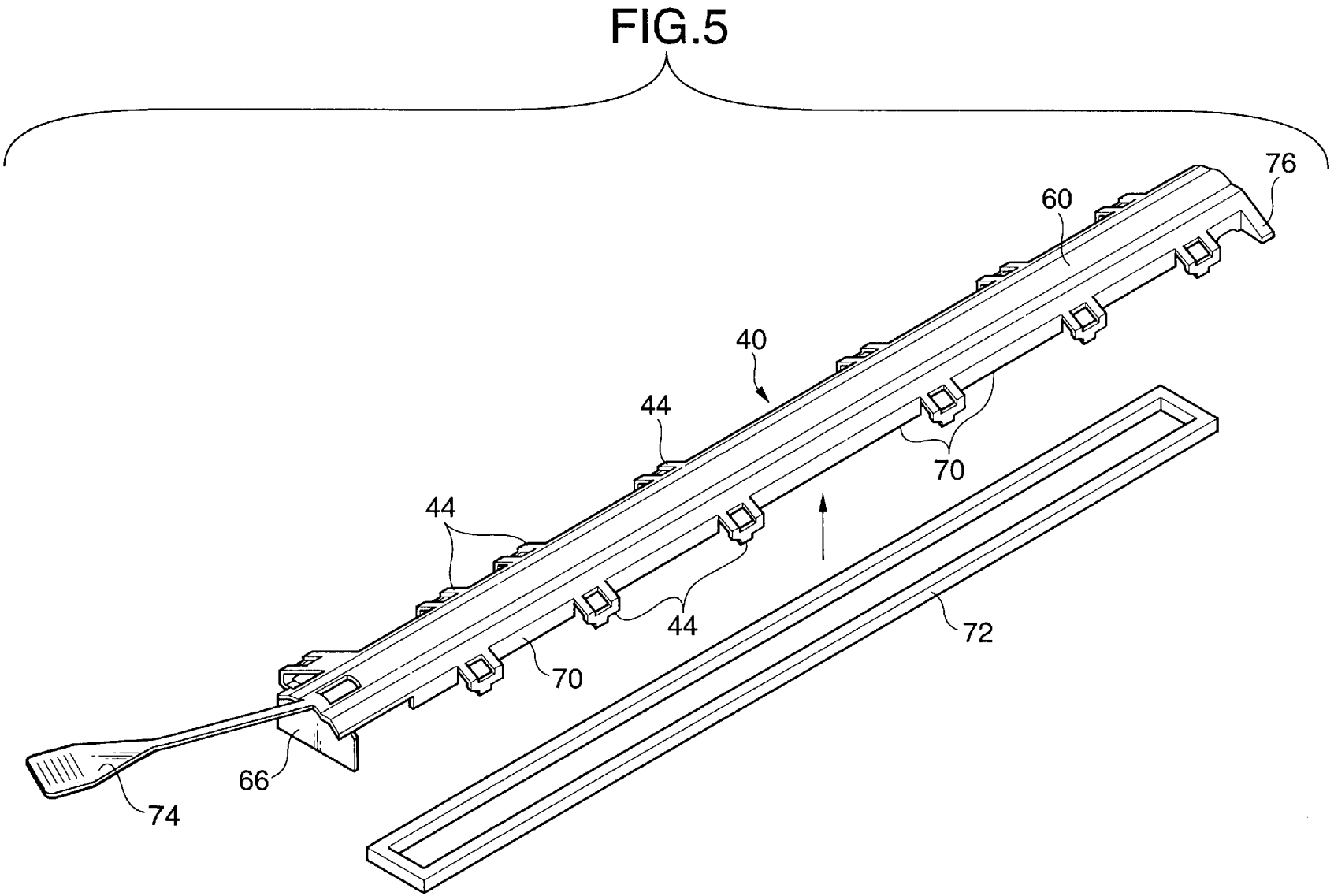
FIG. 5 is a perspective view of the developing unit cover of the developing device according to this embodiment.
Figure 6:
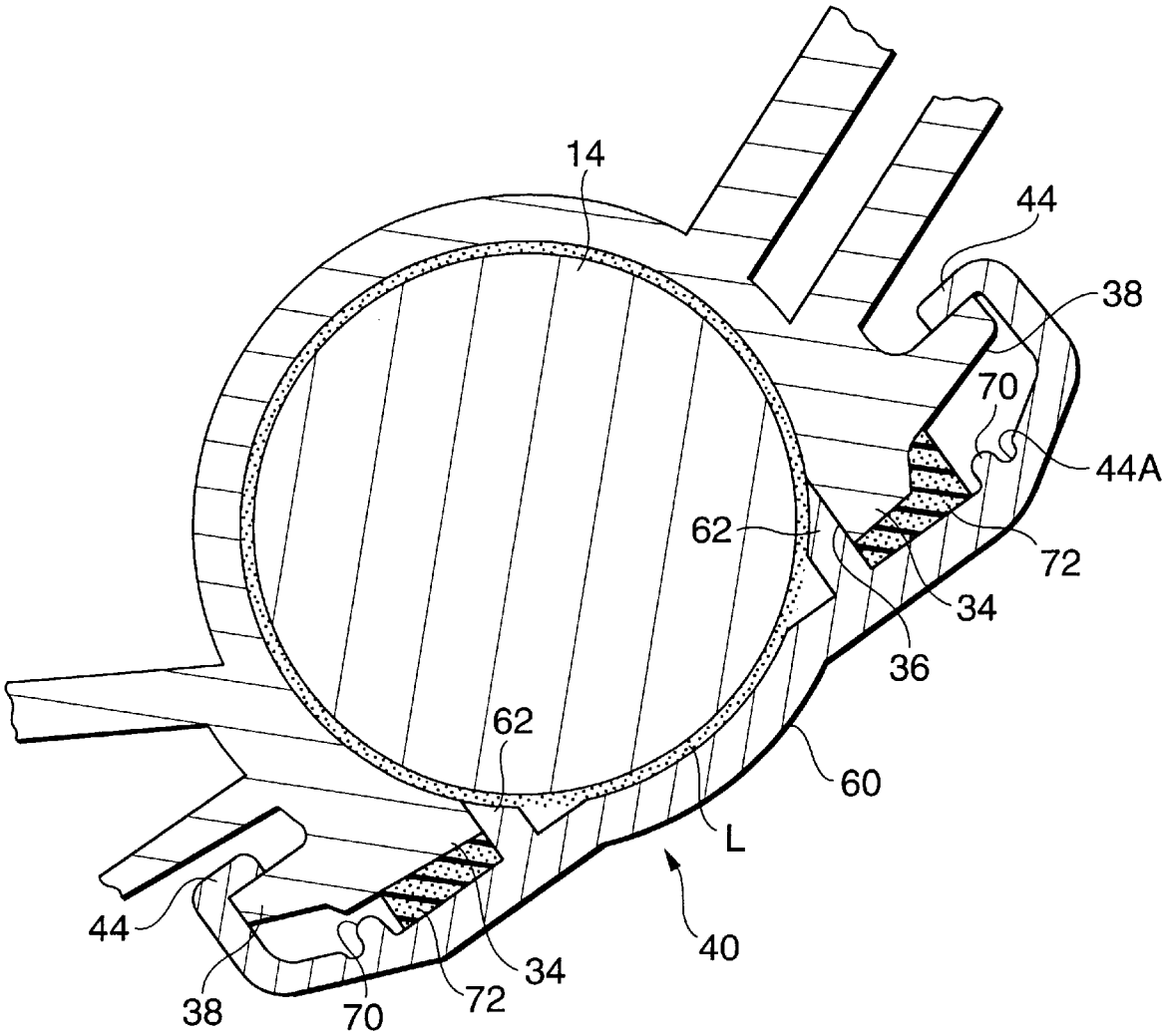
FIG. 6 is an enlarged cross-sectional view showing the relationship between the developing roller and the developing unit cover of the developing device according to this embodiment.

As shown in FIG. 5 and FIG. 6, the developing unit cover 40 includes a cover plate 60 which is made of an elongated plate having a curved central portion, wherein the curvature thereof corresponds to the curvature of the outer peripheral surface of the developing roller 14). This cover plate 60 covers the outer peripheral surface of the developing roller 14 which is exposed through the opening portion 36. The thickness of the cover plate 60 is designed such that even when the rotator 26 is rotated by an error, it does not come into contact with any other part but the photosensitive drum 16.

The cover plate 60 is made longer than the developing roller 14 and two rows of ribs 62 are formed on the rear surface (developing roller side) of the cover plate 60 in a given spaced apart manner.

The length of these ribs 62 is determined such that it covers the region of the developing roller 14 to which the developer L is adhered. Furthermore, the ribs 62 have extremities thereof cut obliquely so that the ribs 62 can be easily inserted into gaps formed between the outer peripheral surface of the developing roller 14 and the opening portion 36. The gaps are sealed by these ribs 62 thereby an overflow of the developer L can be prevented.

Furthermore, the ribs 62 have extremities thereof come into contact with the developer L adhered to the developing roller 14 and forms walls made of the developer L between the developing roller 14 and the ribs 62. These walls prevent the overflow of the developer L.

On the other hand, on both lateral ends of the cover plate 60, hollow claws 44 which are bent in a J-shape and have thin portions 44A thereof formed in a given interval which corresponds to the interval of previously mentioned engaging members 38. By engaging these claws 44 to the engaging members 38, the developing unit cover 40 can be mounted on the developing unit 20 mounted on the rotator 26. Stopper plates 66 which are mounted on one end portion of the cover plate 60 abuts the case 32 to position the claws 44 such that the claws 44 can be registered to the engaging portions 38.

In this manner, since the claws 44 and the engaging portions 38 are not formed continuously but partially or intermittently in a longitudinal direction, by merely withdrawing the developing unit cover 40 by a slight pulling in a direction of the developing roller 14, the developing unit cover 40 can be removed from the developing unit 20.

Furthermore, by adopting the provision that the developing roller 14 is removed in an axial direction, it is unnecessary to form an opening which covers the entire axial length of the developing roller 14 in the image forming apparatus 10 for removing the developing unit cover 40. Accordingly, the above-mentioned position (take-out opening 22) for replacing the developing cartridge 46 is utilized so that the rigidity of the housing 68 of the image forming apparatus 10 can be maintained.

Furthermore, to one widthwise end of the cover plate 60, a flange 70 which extends in a longitudinal direction is provided. A foamed urethane 72 having a rectangular shape is interposed between the flange 70 and the rib 62 in such a manner that foamed urethane 72 surrounds the ribs 62.

When the developing unit cover 40 is mounted on the developing unit 20, this foamed urethane 72 is pressed to the ends of the housings 34 and is deformed by pressure and hence, surrounds the peripheral portion of the opening portion 36. Accordingly, the gap between the opening portion 36 and the developing unit cover 40 is completely sealed so that the overflow of the developer can be eliminated.

The foamed urethane 72 is made of a material having a thickness of 2 mm–5 mm and a low hardness is used. As other material for the foamed urethane, the ester foam, the micro cell polymer sheet and the like can be considered. Such a foamed urethane 72 is compressed to approximately one sixth of the original volume and can follow a warp of the opening portion 36 so that high sealing characteristics can be obtained. The hardness (density) of the foamed urethane 72 may be preferably 28–65 kg/m$^3$.

Furthermore, an elongated thin holding member 74 made of soft resin is provided to one end of the developing unit cover 40. The holding member 74 has a widened end portion to facilitate gripping of the holding member 74 with fingers. By pulling this holding member 74, the developing unit cover 40 can be easily removed from the developing unit 20.

Furthermore, because of its flexibility, even when the holding member 74 comes into contact with the side plate 18 of the rotator 26, the holding member 74 suffers from no damage. In the same manner, even when the holding member 74 is sandwiched between the front cover 24 of the image forming apparatus 10 and the rotator 26, the holding member 74 suffers from no damage although the holding member 74 will be deformed.

Still furthermore, a protrusion 76 protrudes in a widthwise direction from the other end (opposite to holding member-side end) of the developing unit cover 40. When the rotator 26 is rotated manually, this protrusion 76 comes into contact with one of flanges 50 provided to both ends of the photosensitive drum 16 so that the rotation of the rotator 26 is stopped. Accordingly, the image region of the photosensitive drum 16 where the image is formed is prevented from damage which may be caused by the cover plate 60 of the developing unit cover 40.

The manner of handling the rotary developing device according to this embodiment is hereinafter explained.

First of all, before packing the image forming apparatus 10, as shown in FIG. 2 and FIG. 3, the developing unit covers 40 are mounted on the opening portions 36. Due to such a provision, there is no fear that the developer will overflow through the opening portions 36 due to vibration or impact by falling during the transportation of the image forming apparatus 10. In case the transportation of the image forming apparatus 10 without making the image forming apparatus 10 up side down is assured, it is sufficient to mount the developing unit cover 40 only to the opening portion 36 of the developing unit 20 which is located at the lowermost position.

Simultaneously with the above operation, the fixed plate 54 is mounted so as to fix the developing units 20 to the rotator 26 and to prevent the tracking rollers 48 of the developing rollers 14 from coming in contact with the photosensitive drum 16. Subsequently, as shown in FIG. 8, the rotary knob 28 of the rotator 26 is engaged with the recessed portion 30A so as to connect the protective cover 30 to the photosensitive unit 12.

The above-mentioned provisions and operational steps are provided as double or triple measures for making a user recognize the presence of the developing unit cover 40 without fail even in a worst case that the user pays no attention to the developing unit cover 40. It is sufficient to provide a single developing unit cover 40 if mere prevention of the overflow of the developer L is required.

When the image forming apparatus 10 is delivered to the user, first of all, as shown in FIG. 9, the photosensitive unit 12 is removed from the image forming apparatus 10 to remove the protective cover 30. Thereafter, even when the rotator 26 is rotated by an error, there is no fear that the developing unit cover 40 will cause damage to the photosensitive drum 16 since the photosensitive unit 12 is not present in the image forming apparatus 10.

Then, even when the user tries to load the developer cartridge 46 which is delivered separately into the image forming apparatus 10, such a loading operation is impeded by the presence of the fixed plate 54. Namely, the user cannot load the developer cartridge 46 through the inlet opening of the casing 42. Then, the user tries to remove the fixed plate 54 as an inevitable step. In this removing operation, since the developing unit cover 40 is connected to the fixed plate 54, the developing unit cover 40 is withdrawn along with the removal of the fixed plate 54 so that the user recognizes the presence of the developing unit cover 40. Accordingly, the developing unit cover 40 is also removed from the developing unit 20 without fail.

When all developing unit covers 40 are removed, the photosensitive unit 12 is again mounted in the image forming apparatus 10 and the developer cartridges 46 are loaded into the developing units 20. Here, when a power source of the image forming apparatus 10 is turned on, the rotator 26 is rotated at a high speed in a sequence which is different from that of the usual operation so as to uniformly agitate the developer L which is solidified during the course of transportation of the image forming apparatus 10. Accordingly, a trouble that the developer L is not fed at the time of printing can be eliminated.

What is claimed is:

1. A developing device comprising a plurality of developing units each of which stores a developer containing at least a toner and a carrier and transfers said developer to each of a plurality of developing rollers, a plurality of removable developer cartridges each of which supplies said developer to said each developing unit, a rotator which holds said plurality of developing units, said plurality of developing units successively face a photosensitive drum along with the rotation of said rotator to produce a multicolor image, and a closure member removably provided to an opening portion of said each developing unit through which said each developing roller is exposed to close said opening portion, wherein an amount of protrusion of said each closure member from said rotator is set to a value which prevents said closure member from coming into contact with any parts except for said photosensitive drum when said rotator is rotated.

2. The developing device according to claim 1, wherein said closure member is provided to said developing device at the time of shipping an image forming apparatus on which said developing device is mounted, while said closure member is removed from said developing device after installation of said image forming apparatus.

3. The developing device according to claim 1, wherein said closure member has a size which allows providing and removing said closure member without being interfered by said rotator.

4. The developing device according to claim 1, wherein a direction of removing said each closure member is the axial direction of said each developing roller.

5. The developing device according to claim 4, wherein a position where said each closure member is removed is a position where said each developer cartridge is replaced.

6. The developing device according to claim 1, wherein a holding member is provided to an end portion of said each closure member.

7. The developing device according to claim 6, wherein said holding member is an elongated holding member having flexibility.

8. The developing device according to claim 1, wherein a protrusion which comes into contact with a flange portion of said photosensitive drum when said rotator is rotated is provided to said each closure member.

9. The developing device according to claim 1, wherein said each closure member is provided with a shield member which shields an inlet opening of a loading portion where said each developer cartridge is loaded.

10. The developing device according to claim 1, wherein said each closure member comprises a cover plate which covers said each opening portion through which said each developing roller is exposed, a plurality of claws which protrude from said cover plate and are engaged with a plurality of engaging members which are mounted on the peripheral portion of said each opening portion, and two rows of ribs which are protruded from the rear surface of said cover plate and inserted into gaps formed between said developing roller and said opening portion.

11. The developing device according to claim 10, wherein each rib of said two rows of ribs has a taper-shaped end portion and said end portion comes into contact with said developer adhered to said developing roller.

12. The developing device according to claim 10, wherein an elastic seal member is compressed and located outside of said ribs and surrounding the peripheral portion of said each opening portion.

13. The developing device according to claim 12, wherein said elastic seal member is made of a foamed urethane having coarse pores.

14. The developing device according to claim 10, wherein said plurality of claws and said plurality of engaging members are formed in a given interval in the axial direction of said each developing roller and said each claw is disengaged from said each engaging member with a small movement of said claw.

15. The developing device according to claim 1, wherein a stopper member which stops the rotating operation of said rotator is connected to said photosensitive drum.

16. The developing device according to claim 15, wherein said stopper member comprises a protective cover which is connected to said photosensitive drum and a recessed portion formed in said protective cover to be engaged with a knob mounted on the axial portion of said rotator.

17. A developing device comprising a plurality of developing units, each of which accommodates a developer containing at least a toner and a developing roller and holds said developing roller while exposing a part of said developing roller, and a removable closure member which closes an opening portion of said each developing unit through which said developing roller is exposed, wherein a holding member is provided to an end portion of said each closure member.

18. A method for using a developing device characterized in that a plurality of developing units each of which accommodates a developer containing at least a toner and a developing roller and holds said developing roller while exposing a part of said developing roller, and a removable closure member which closes an opening portion of said each developing unit through which said developing roller is exposed are provided, and said closure member is mounted before installing said developing unit or an image forming apparatus on which said developing unit is mounted, said closure member is removed after installing said developing unit or said image forming apparatus on which said developing unit is mounted, and providing a holding member to an end portion of each said closure member.

19. A developing device, comprising:

a plurality of developing units each of which stores a developer containing at least a toner and a carrier and transfers said developer to each of a plurality of developing rollers, a plurality of removable developer cartridges each of which supplies said developer to said each developing unit, a rotator which holds said plurality of developing units, said plurality of developing units successively face a photosensitive drum along with the rotation of said rotator to produce a multicolor image, and a closure member removably provided to an opening portion of said each developing unit through which said each developing roller is exposed to close said opening portion, wherein a holding member is provided to an end portion of said each closure member.

* * * * *